United States Patent [19]

Collier

[11] 3,976,317

[45] Aug. 24, 1976

[54] STRIKE PLATE CONSTRUCTION FOR SLIDING GLASS DOOR OR WINDOW LOCK

[75] Inventor: John Philip Collier, Sacramento, Calif.

[73] Assignee: Blomberg Glass, Sacramento, Calif.

[22] Filed: Jan. 2, 1976

[21] Appl. No.: 646,250

[52] U.S. Cl. ..... 292/340

[51] Int. Cl.[2] ..... E05C 3/16

[58] Field of Search..... 292/340, 341.19, 346, 292/97, 100, DIG. 49; 49/449; 70/99;100

[56] References Cited

UNITED STATES PATENTS

| | | | |
|---|---|---|---|
| 2,742,309 | 4/1956 | Hillgren | 292/100 |
| 3,368,374 | 2/1968 | Eads | 70/100 |
| 3,630,558 | 12/1971 | Andreini | 292/87 |
| 3,705,505 | 12/1972 | Landow et al. | 70/99 |

*Primary Examiner*—Richard E. Moore
*Attorney, Agent, or Firm*—Lothrop & West

[57] ABSTRACT

A vertically elongated metal strike plate is mounted on the lock jamb of a sliding glass door or window by a pair of screws disposed on a substantially horizontal central plane through a vertically elongated strike plate aperture. The strike plate is vertically positioned so that when the door or window is slid into closed position and the lock stile is moved into abutment with the jamb, the latch hook projects through the registering central aperture. Then, when the latch is elevated by actuation of the locking lever the hook interferes with the upper back surface of the strike plate and prevents separation of the lock stile and the jamb.

In the event that pry-bar forces should be exerted in an attempt to gain entry, the latch hook engages and bends the upper half of the strike plate toward the adjacent lock face, the inclination of the bent portion of the strike plate counteracting the tendency of the strike plate metal in the vicinity of the hook to deform, with the result that substantially full engagement between the hook and the back side of the strike plate is maintained despite the application of considerable pry-bar efforts. Still greater resistance to intrusion is afforded by locating the strike plate in a C-shaped channel formed by flanges on the face of the jamb so that the resistance of the strike plate and the two flanges must be overcome.

7 Claims, 7 Drawing Figures

FIG-1
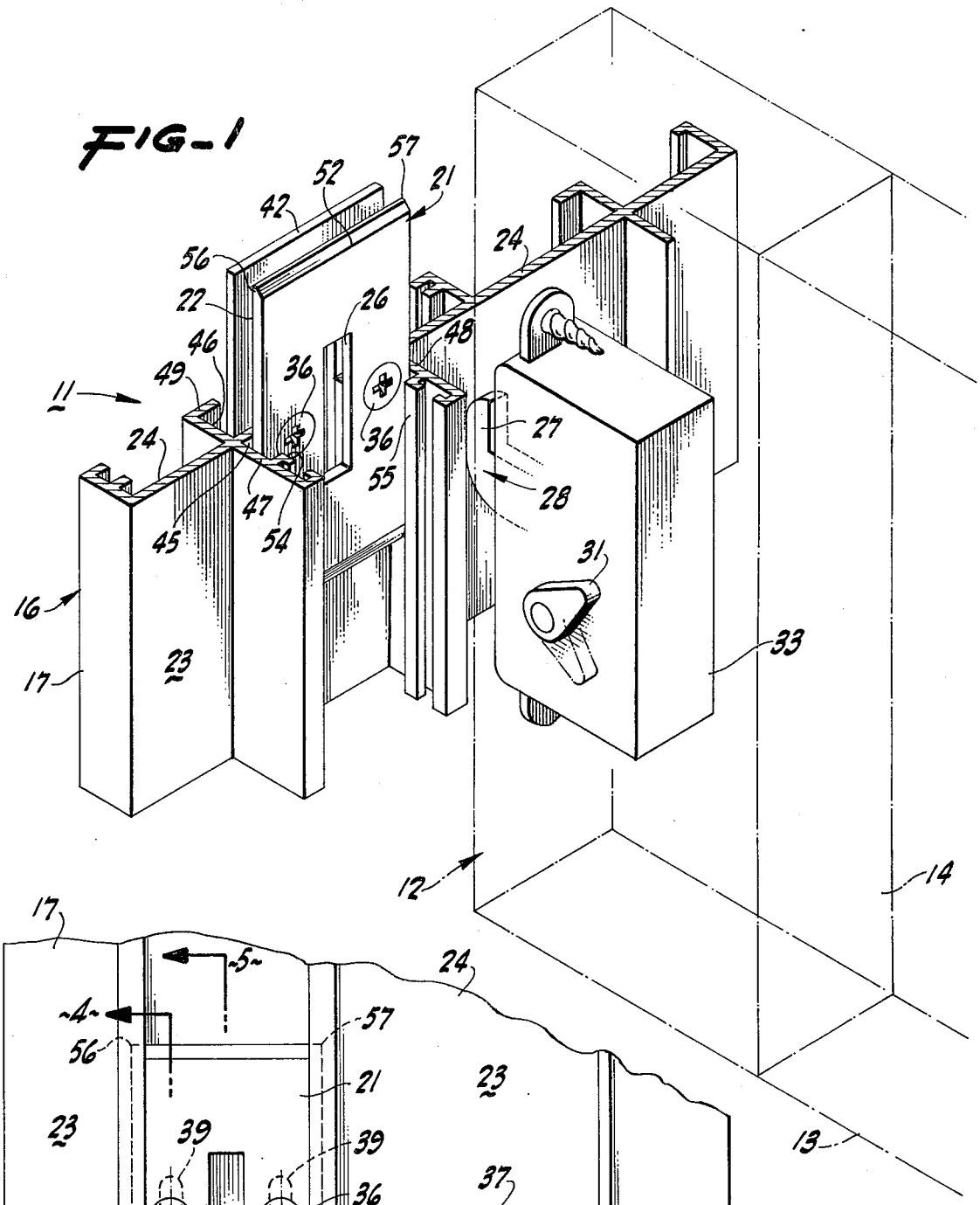
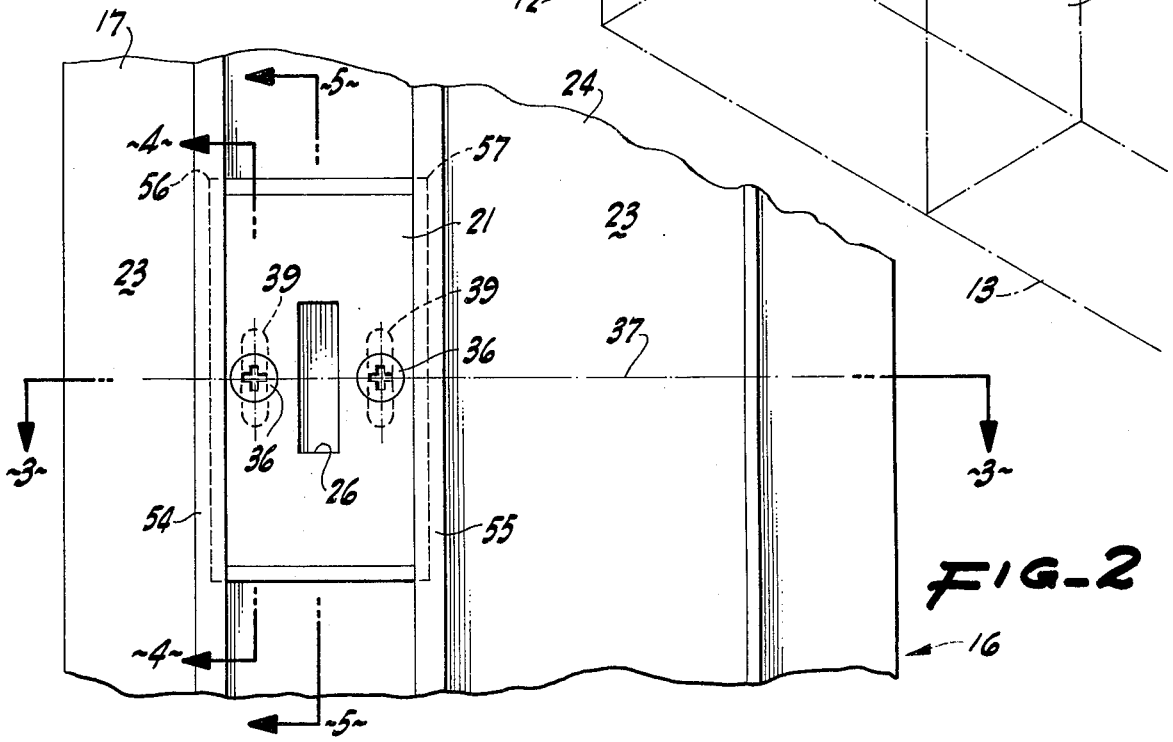
FIG-2

FIG-3
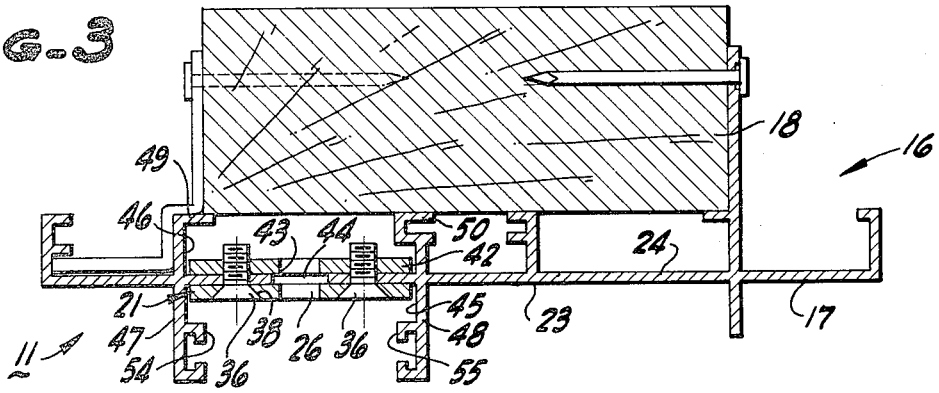
FIG-5
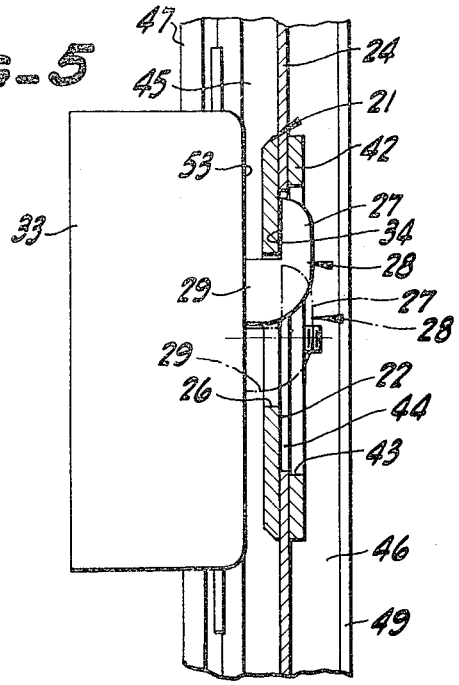
FIG-4
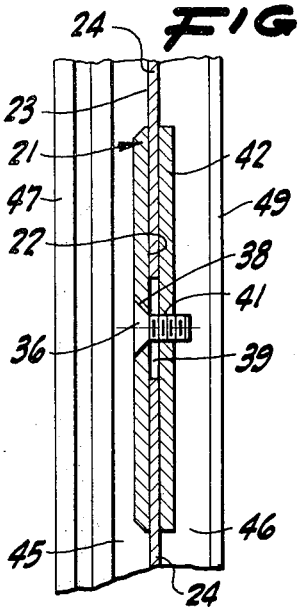
FIG-6
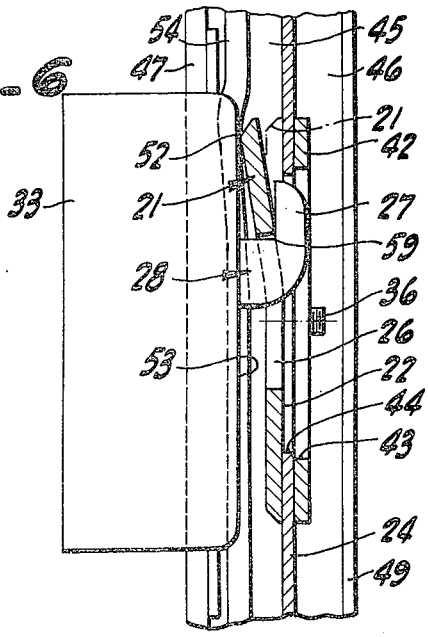
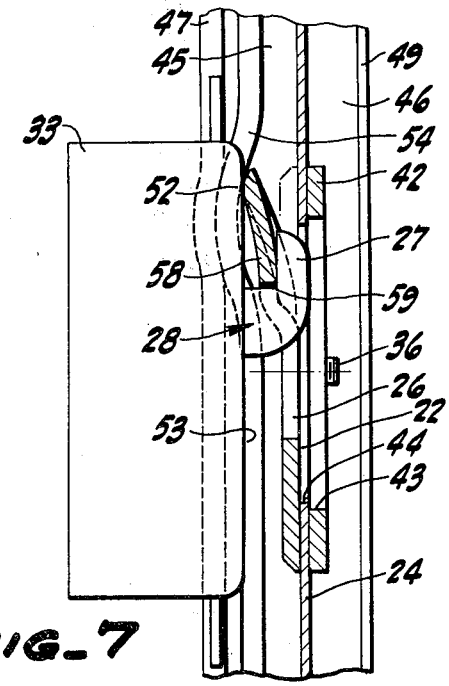
FIG-7

STRIKE PLATE CONSTRUCTION FOR SLIDING GLASS DOOR OR WINDOW LOCK

BACKGROUND OF THE INVENTION

So far as is known, most, if not all, strike plates heretofore used as part of the security hardware in sliding glass door and window installations have been of the vertically-elongated metal plate type mounted on the outer face of the lock jamb by a pair of screws located near the top and the bottom of the plate and in a median vertical plane.

The vertical central plane in which the two screws are located passes through the customary central aperture in the strike plate, the aperture being positioned so as to register with the usual L-shaped latch hook as the hook moves through the aperture just prior to or just subsequent to engagement between the hook and the back face of the strike plate. When the vertical limb of the hook projects upwardly from the horizontal limb, the vertical limb lies in back of the portion of the strike plate above the central aperture when the latch hook is raised into locked position. Thus, when the door or window is urged toward open position without disengaging, i.e. lowering the latch hook, the upstanding limb of the hook abuts the back face of the strike plate and resists movement of the door or window in an opening direction.

Strike plates in which the two mounting screws are located in a median vertical plane, as just described, provide adequate resistance against moderate forces tending to pry the lock stile of the door or window away from the lock jamb of the installation. However, under the stresses exerted by forceful pry bar or large screwdriver efforts, the previous installations leave much to be desired. The upstanding limb of the latch hook exerts a strong outward force on the adjacent back face of the strike plate and tends to bend outwardly the upper portion of the strike plate. Bending often takes place about a horizontal axis passing through the upper one of the two screws holding the strike plate. As deformation proceeds, both the upper and lower portions of the strike plate bend outwardly even more, so that eventually the central aperture becomes vertically enlarged in size until the latch hook is no longer engaged and the door or window can be opened.

In other words, when the upstanding limb of the latch hook of a locked, sliding, glass door or window has been forcefully urged against the back side of a strike plate mounted with the screws lying in a median vertical plane, as in previous lock hardware, the edge of the hook deforms the metal in the path of the hook. Although the leading edge of the hook is not knife-sharp, it nevertheless is effective, where sufficient force is applied, to distort and bend the metal outwardly and upwardly, particularly in the vicinity of the upper margin of the central aperture of the strike plate, to such an extent that the hook is able to move through the vertically enlarged aperture and thus disengage the strike plate, allowing the sliding vent to be opened and permitting access to the interior.

SUMMARY OF THE INVENTION

The invention relates to an improved strike plate construction for use with a sliding glass door or window installation.

It is an object of the invention to provide a strike plate construction which is capable of resisting relatively large pry bar forces exerted on a locked sliding glass door or window.

It is another object of the invention to provide a strike plate construction which is versatile in that it can, with facility and advantage, be applied to sliding glass door and window installations of the single sliding vent and single fixed vent type, mounted either right-handed or left-handed, or to installations of the double fixed and single sliding vent type in which a central false jamb is utilized, or to numerous other combinations of vents and mountings.

It is yet another object of the invention to provide a strike plate construction which is relatively economical, yet is sturdy and attractive in appearance, and which is easily adjustable in a vertical direction so as to facilitate quick and accurate alignment between the strike plate's central aperture and the latch hook.

It is a further object of the invention to provide a generally improved strike plate construction.

Other objects, together with the foregoing, are attained in the embodiment described in the following description and illustrated in the accompanying drawings.

BRIEF DESCRIPTION OF THE DRAWINGS

FIG. 1 is a fragmentary perspective view of a strike plate of the invention installed on a typical door or window jamb, the jamb being sectioned on a horizontal plane located somewhat above the horizontal plane through the two plate-securing screws, and also showing, in phantom, a portion of a door or window with a lock, lock lever and latch hook, the latch hook being in register with the central aperture in the strike plate, the position of the lock lever and latch hook in locked mode being shown in broken line;

FIG. 2 is a fragmentary front elevational view of the strike plate construction;

FIG. 3 is a median, horizontal sectional view of the strike plate construction, the plane of the section being indicated by the line 3 — 3 in FIG. 2;

FIG. 4 is a fragmentary vertical sectional view taken on the line 4 — 4 in FIG. 2;

FIG. 5 is a fragmentary median vertical sectional view taken on the line 5 — 5 in FIG. 2, showing in full line the position of the hardware under normal closed conditions, and, in broken line, the lowered location of the latch hook when the lock is disengaged or "open";

FIG. 6 is a view comparable to FIG. 5 but showing the deformation of the upper half of the strike plate and confining flange of the jamb resulting from forceful pry bar effort; and, FIG. 7 is a view comparable to FIG. 6 showing how, despite further deformation of the strike plate material, the latch hook remains in engaged position.

DETAILED DESCRIPTION OF PREFERRED EMBODIMENT

While the strike plate construction of the invention is susceptible of numerous physical embodiments, depending upon the environment and requirements of use, substantial numbers of the herein shown and described embodiment have been made, tested, used and sold, and all have performed in an eminently satisfactory fashion.

The strike plate construction of the invention, generally designated by the reference numeral 11, finds its greatest utility in conjunction with a sliding closure, such as a sliding glass door or window installation 12, in which a sliding vent 13 provided with a lock stile 14 moves toward or away from a lock jamb structure 16 as the vent is closed or opened.

In most such installations, the lock jamb structure 16 comprises an extruded metal lock jamb 17 appropriately secured to a vertical wooden jamb 18 (see FIG. 3) forming a part of the closure frame. Such construction is conventional and therefore requires no detailed description.

The strike plate construction 11 includes a vertically elongated metal strike plate 21 mounted with its back face 22 against the outer face 23 of the vertical planar web 24 of the metal jamb 17.

The strike plate 21 includes a vertically elongated central aperture 26 through which projects the vertical limb 27 of a conventional L-shaped latch hook 28 when the door or window is closed. The vertical limb 27 extends upwardly from the inner end of a horizontal limb 29 of the latch hook 28.

When the closed door or window is to be locked, a locking lever 31 on the side of the lock stile 14 is pivoted downwardly, thereby actuating the mechanism inside the lock 33 and elevating the latch hook 28 so that the vertical limb 27 is positioned behind the strike plate 21 with the outer edge 34 of the vertical limb 27 closely juxtaposed to the back face 22 of the strike plate 21. FIG. 5 illustrates in broken line the position of the latch hook in disengaged position, and in full line the position of the latch hook in locked, or engaged, position.

The strike plate is held in position by a pair of screws 36, preferably of the Phillips, or crosshead type, straddling the central aperture 26 and lying in a median horizontal plane 37 (see FIG. 2).

The screws 36 extend through beveled screw holes 38 in the strike plate, thence through respective vertical slots 39 in the web 24 of the jamb 17 and into threaded engagement with a respective pair of tapped openings 41 in a back-up plate 42 (see FIG. 4) located on the nether side of the web 24.

The back-up plate 42 is comparable in size, shape and material to the strike plate 21. A central vertically elongated slot 43 in the back-up plate 42, however, considerably exceeds the vertical length of the central aperture 26 in the strike plate 21 and, in fact, is preferably of substantially the same height as a central vertically elongated opening 44 in the web 24.

The vertical elongation of the slots 39 in the web 24 facilitates mounting the strike plate 21 and the back up plate 42 on the web and the vertical elongation of the respective opening 44 and slot 43 in the web 24 and back up plate 42 assure that registry is established between the opening 44 and slot 43, as well as the strike plate aperture 26, even though some degree of relative vertical positioning is required during installation of the strike plate 21.

In order to enhance the strength of the strike plate installation, the strike plate 21 and the back up plate 42 are lodged in respective channels 45 and 46 (see FIGS. 1 and 3) defined by suitable recurved flanges formed in the jamb. For example, a recurved first flange 47 and a recurved second flange 48 projecting outwardly from the web 24 form the outer channel 45 for the strike plate 21; and a recurved third flange 49 and recurved fourth flange 50 projecting inwardly from the web 24 delineate the inner channel 46 for the back up plate 42.

As is well known, given sufficient time and adequate tools in the hands of a skilled invader, sliding glass closures are capable of being penetrated. On the other hand, where considerable time and the expenditure of considerable effort are required to effect entry, the risk of apprehension may deter the attempted intruder from continued attack and other, more vulnerable, installations may then be sought.

In installations where the strike plate is secured to the jamb by a pair of screws located in a median vertical plane, with one screw above the latch hook aperture and other below the aperture, pry bar efforts have heretofore been all too successful in disengaging the hook from the strike plate. As previously explained, when the hook is in locked position, the vertical edge of the hook in engagement with the back face of the strike plate exerts large force against the strike plate when pry bar efforts are applied in a door or window opening direction. The force imposed by the hook on the metal above and in the vicinity of the latch hook aperture often is sufficient to cause the metal to bulge and to bend upwardly and outwardly where the hook encounters the upper margin of the central aperture. In the case of strike plates secured by vertically aligned screws, one located near the top of the plate and one located near the bottom of the plate, the bulging and bending of the metal often results in vertically enlarging the central aperture to the point where the upstanding limb of the hooks breaks free through the enlarged aperture, thereby allowing the sliding vent to be opened. Since the vertical marginal strips defining the central aperture are not constrained in any way except by their own beam strength, both the upper and lower portions of the plate are easily bent outwardly in the vicinity of the latch hook and the aperture thus readily becomes enlarged to the point where the latch hook is released.

As appears most clearly in the sequence illustrated in FIGS. 5 through 7, however, it can be seen that the present strike plate construction counteracts the heretofore encountered distortion of the metal and consequent enlargement of the aperture which releases the hook. The sequence will now be described.

FIG. 5 illustrates the strike plate 21 and latch hook 28 in normal position when the door or window is locked. The strike plate lies entirely within a vertical plane.

In the event pry bar force is applied to the sliding vent 13 and the lock 33 in a left-hand direction, the upstanding limb 27 of the latch hook 28 engages the adjacent back face 22 of the strike plate, and in particular, that portion of the back face above and in the vicinity of the top edge of the central aperture 26 of the strike plate.

When sufficient force is applied, the hook 28 deforms the upper half of the strike plate, i.e. that portion of the strike plate above the median horizontal plane 37 extending through the two mounting screws 36.

Since the strike plate is of relatively strong steel, a substantial amount of energy must be expended to bend the upper half of the strike plate 21 from the vertical attitude shown in broken line in FIG. 6 to the outwardly and downwardly inclined position shown in full line in FIG. 6, at which juncture the upper leading edge 52 of the strike plate 21 engages the adjacent face 53 of the lock 33 and provides a wedging effect between the lock face 53 and the inside corner 59 of the hook 28. The upper portion of the strike plate adjacent the inside corner 59 of the hook 28 is displaced only a negligible amount from the vertical plane of the plate and the central aperture remains at its initial size. Full engagement still obtains between the hook and the strike plate.

In fact, owing to the presence of the transversely recurved portion 54 of the flange 47 and the transversely recurved portion 55 of the flange 48 (see FIG. 1), the pry bar effort begins to encounter significant resistance as soon as the upper lateral corner 56 of the strike plate underlying recurved portion 54 and the upper lateral corner 57 underlying recurved portion 55 (see FIG. 2) come into engagement with the flange portions 54 and 55. In order to deform both the strike plate and the flanges, the intruder must exert substantial effort, which is necessarily accompanied by noise and takes time.

In short, it can be seen at this juncture (FIG. 6), that despite the application of a very considerable pry bar force, the vertical limb 27 of the latch hook is still firmly lodged in place. Security is in no way impaired, yet the noise generated by the intrusion effort tends to attract attention and begins to subject the intruder to considerable risk of detection and apprehension.

Should the intruder persist, however, and apply a very large pry bar effort to the sliding vent 13, the hook limb 27 begins to deform the adjacent portion of the strike plate so that an outward bulge 58 is initially created with the greatest displacement occurring where the inside corner 59 of the hook 28 engages the adjacent corner of the horizontal upper edge of the central aperture 26 of the strike plate 21.

Not only does the further deformation of the metal of the strike plate 21 absorb additional energy in creating the bulge 58, but the further bending of the recurved flange portions 54 and 55 also requires the expenditure of work and the generation of a disconcertingly loud series of noises which may deter further efforts of the intruder.

Despite the efforts exerted by the intruder, however, to produce the condition shown in FIG. 7, the latch hook 28 is still securely lodged in locked position and the invasion attempt is frustrated. Even after further and stronger efforts are exerted, and the bottom of the bulge is displaced still further outwardly out of the plane of the bottom of the strike plate, the bulge 58 is reversed and assumes a substantially vertical attitude parallel to the lock face 53 and the adjacent latch hook face. Firm engagement between the latch and the strike plate thus continues and full integrity of the lock installation is maintained.

Owing to the centrally anchored plate construction, force of an extremely high order is required to bend or rupture the metal of the strike plate to a sufficient height so as to release the hook. The amount of effort and time required to gain entry, as well the attendant noise, would be such that there is at least some likelihood that a prospective intruder might either be apprehended or desist and turn to another target.

What is claimed is:

1. In combination with a sliding glass door or window having a lock stile with a lock and latch hook having a horizontal limb and a vertical limb movable between a first position removed from the outer face of a metal lock jamb having an outer face and an inner face, a second position in which the lock style and the lock are in close juxtaposition to the lock jamb and the vertical limb of the latch hook projects at least partially through an opening in the lock jamb, and a third position in which the latch hook is located vertically above said second position, a strike plate construction comprising:

a. a vertically elongated metal strike plate having a front face and a back face, an upper end, a lower end and a pair of side edges, said plate having a central aperture; and, b. a pair of screws passing through a pair of screw holes straddling said central aperture, said screw holes being located in a horizontal plane intercepting said central aperture, said screws securing said back face of said strike plate to said outer face of said lock jamb with said central aperture in said strike plate in register with at least a portion of said opening in said lock jamb, said vertical limb of said latch hook being in register with and projecting through said central aperture in said strike plate in said second position, said vertical limb of said latch hook being in face to face engagement with said back face of said strike plate in said third position to prevent movement of the door or window toward said first position.

2. A strike plate as in claim 1 including a back up plate located on said inner face of said lock jamb, said back up plate including a pair of threaded openings for engagement with said pair of screws, said screws passing through a registering pair of openings in said lock jamb.

3. A strike plate as in claim 2 further including a first spaced pair of vertical flanges mounted on and projecting outwardly from said lock jamb adjacent said side edges of said strike plate, said vertical flanges including recurved portions extending toward each other to form a C-shaped channel embracing said strike plate.

4. A strike plate as in claim 3 further including a second spaced pair of vertical flanges mounted on and projecting inwardly from said lock jamb, said vertical flanges including recurved portions extending toward each other to form a C-shaped channel embracing said back up plate.

5. A strike plate as in claim 1 in which the upper portion of said strike plate above said horizontal plane resists the outward movement of said latch hook in said third position but is capable of being bent outwardly by preliminary supervening pry-bar force transmitted by said latch hook in excess of the elastic limit of the metal of said strike plate into abutment with the adjacent portion of said lock.

6. A strike plate as in claim 5 in which the portion of said strike plate engaged by said latch hook resists the outward movement of said latch hook in said third position but is capable of being deformed outwardly by further supervening pry-bar force transmitted by said latch hook in excess of the elastic limit of the deformation resulting of said strike plate, the deformation-resulting from the further supervening force being effective to counteract the bending effected by the preliminary supervening force so that said latch hook remains lodged in said strike plate.

7. A strike plate as in claim 6 in which said recurved portions of said C-shaped channel embracing said strike plate resist the outward movement of said strike plate and said latch hook in said third position of said latch hook but are capable of yielding to pry-bar efforts transmitted by said latch hook in excess of the elastic limit of the material of said channel.

* * * * *